US006533227B1

(12) United States Patent
Rom

(10) Patent No.: US 6,533,227 B1
(45) Date of Patent: Mar. 18, 2003

(54) ADJUSTABLE SUPPORT FOR HOLDING A PAINT BUCKET OR OTHER CONTAINER

(76) Inventor: Richard V. E. Rom, 355 Newbury, Hercules, CA (US) 94547

( * ) Notice: Subject to any disclaimer, the term of this patent is extended or adjusted under 35 U.S.C. 154(b) by 0 days.

(21) Appl. No.: 10/082,916

(22) Filed: Feb. 25, 2002

(51) Int. Cl.[7] ..... A47G 23/02
(52) U.S. Cl. ..... 248/148; 248/188.2; 248/237
(58) Field of Search ..... 248/148, 397, 248/188.2, 237

(56) References Cited

U.S. PATENT DOCUMENTS

| | | | | |
|---|---|---|---|---|
| 1,193,307 A | | 8/1916 | Sorley | |
| 1,423,726 A | | 7/1922 | Mohr | |
| 1,650,433 A | | 11/1927 | Dages | |
| 2,561,845 A | * | 7/1951 | Curry | 24/32 |
| 2,750,139 A | | 6/1956 | Young | |
| D303,467 S | | 9/1989 | Pepitone | |
| 5,078,350 A | | 1/1992 | Zorichak | |
| 5,141,196 A | * | 8/1992 | Arnold et al. | 248/126 |
| 5,232,187 A | | 8/1993 | O'Farrell et al. | |
| 5,249,397 A | * | 10/1993 | Monaco | 182/45 |
| 5,474,271 A | * | 12/1995 | Raymond | 182/45 |
| 5,558,306 A | | 9/1996 | Binford et al. | |
| 5,913,782 A | * | 6/1999 | Monaco et al. | 182/45 |

* cited by examiner

*Primary Examiner*—Ramon O. Ramirez
(74) *Attorney, Agent, or Firm*—Thomas R. Lampe

(57) ABSTRACT

Apparatus for holding a paint bucket level on an inclined surface, such as a roof surface, includes a sleeve which is clamped around the bucket and a support releasably connected to the sleeve. The support includes two support members which are angularly adjustable. The support is interchangeable with other supports to accommodate differently shaped inclined surfaces.

12 Claims, 3 Drawing Sheets

ADJUSTABLE SUPPORT FOR HOLDING A PAINT BUCKET OR OTHER CONTAINER

TECHNICAL FIELD

This invention relates to a holder for a container which is utilized to maintain the container in level condition on an inclined surface. The invention is particularly applicable for use with a paint bucket to maintain the paint bucket in level condition on an inclined roof.

BACKGROUND OF THE INVENTION

A number of devices have been proposed which are for the purpose of holding paint buckets level on an inclined roof or other surface.

The following patents are believed to be representative of the current state of the prior art in this field: U.S. Pat. No. 1,193,307, issued Aug. 1, 1916, U.S. Pat. No. DES.303,467, issued Sep. 19, 1989, U.S. Pat. No. 2,750,139, issued Jun. 12, 1956, U.S. Pat. No. 1,650,433, issued Nov. 22, 1927, U.S. Pat. No. 1,423,726, issued Jul. 25, 1922, U.S. Pat. No. 5,558,306, issued Sep. 24, 1996, U.S. Pat. No. 5,232,187, issued Aug. 3, 1993, and U.S. Pat. No. 5,078,350, issued Jan. 7, 1992.

As will be seen below, the apparatus of the present invention has a number of features not shown in the prior art which are desirable, including the use of selectively separable components, contributing to the versatility and reliability of the apparatus. For example, the apparatus may readily be adapted for use with inclined roofs having different configurations.

DISCLOSURE OF INVENTION

The apparatus of the present invention is for holding a paint bucket or other container in a stable, level condition on an inclined surface.

The apparatus includes a sleeve for at least partially encircling an outer peripheral surface of the container.

Sleeve adjustment means is provided for varying the size of the sleeve for selectively alternatively either bringing the sleeve into clamping engagement with the outer peripheral surface of the container or disengaging the sleeve from clamping engagement with the outer peripheral surface of the container.

A support is provided for positioning under the bottom of the container and the support includes a first support member and a second support member. The first support member and the second support member are hingedly interconnected by hinge means at adjoining edges thereof whereby the first support member and the second support member may be relatively positioned to define different angles therebetween.

Connector means releasably connects the support to the sleeve.

Lock means is provided for selectively locking the first support member and the second support member against movement in each of the different angles.

The support is one of a plurality of supports having different configurations. The supports are interchangeable to accommodate and adapt the apparatus to different shaped inclined surfaces.

Other features, advantages and objects of the present invention will become apparent with reference to the following description and accompanying drawings.

MODE FOR CARRYING OUT THE INVENTION

Figure 1:
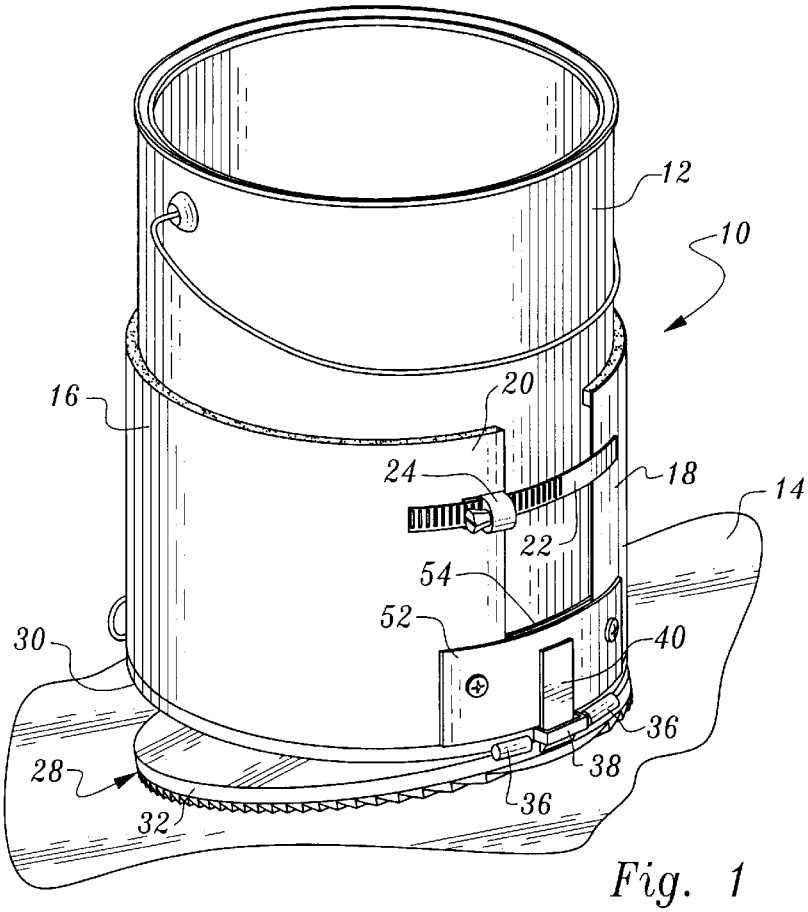
FIG. 1 is a frontal, perspective view showing apparatus constructed in accordance with the teachings of the present invention holding a paint bucket and maintaining the paint bucket in a level condition an inclined roof surface.
Figure 2:
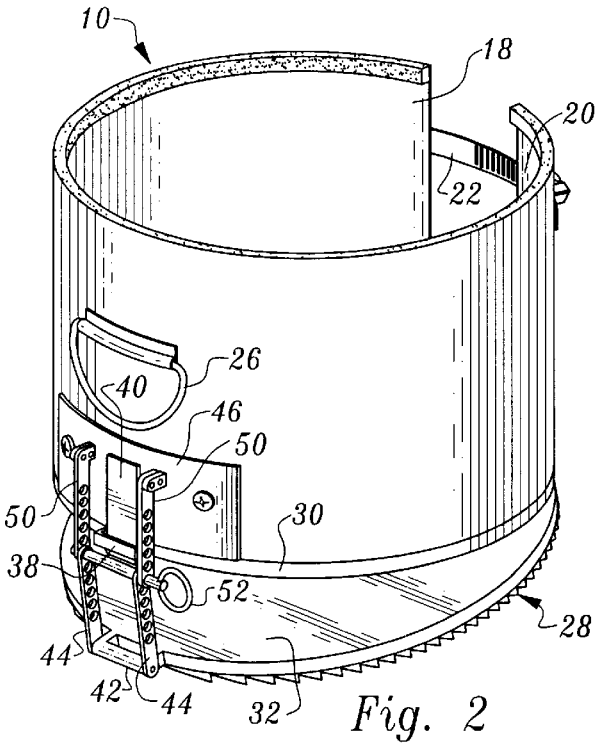
FIG. 2 is a rear, perspective view showing the apparatus without the paint bucket being accommodating thereby.
Figure 3:
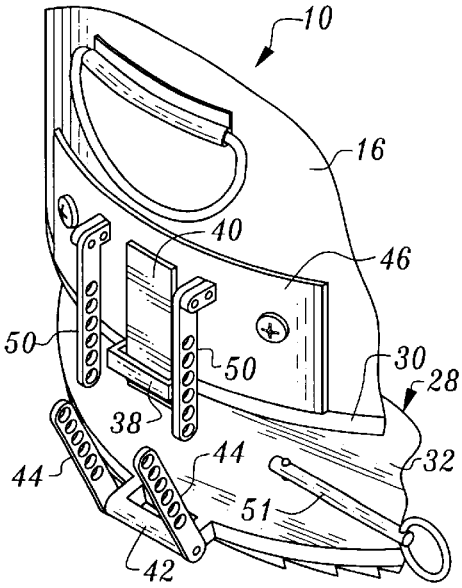
FIG. 3 is an enlarged, perspective view illustrating selected portions of components of the apparatus, including details concerning the lock means employed therein.

Referring now to FIGS. 1–7A, apparatus constructed in accordance with the teachings of the present invention is generally designated by reference numeral 10. FIG. 1 shows the apparatus 10 utilized to hold in a level, stable condition a paint bucket 12, the apparatus 10 resting on an inclined roof 14, only a portion of the latter being shown.

Apparatus 10 includes a sleeve 16 for partially encircling the outer peripheral surface of the paint bucket 12. The sleeve 16 has spaced sleeve ends 18, 20 spaced from one another.

Sleeve adjustment means is provided for varying the size of the sleeve for selectively alternatively either bringing the sleeve into clamping engagement with the outer peripheral surface of the container or disengaging the sleeve from clamping engagement with the outer peripheral surface of the container. More particularly, the adjustment means includes an adjustment band 22 having slots formed therein. A rotatable manually actuatable member 24 is in engagement with the band and includes teeth (not shown) positionable in the slots or openings in the band to tighten or loosen the band. Such mechanisms per se are well known and need not be described. A handle 26 is connected to the sleeve.

Releasably connected to the sleeve for positioning under the bottom of the paint bucket is a support 28 including a top support plate 30 and a lower or bottom support plate 32. Bottom support plate 32 has an irregular lowermost surface for resisting slippage of the apparatus on an inclined surface. This surface may be formed, for example, from rubber, plastic or the like and may be integrally formed with the rest of the bottom support plate or glued or otherwise fastened thereto.

The top support plate and the bottom support plate are hingedly interconnected by hinges 36 at adjoining edges thereof whereby the plates 30, 32 may be relatively positioned to define different angles therebetween.

Top support plate 30 has apertured projections 38 formed thereon at opposed sides of the top support plate. The apertures of these projections releasably receive two latch members 40 on opposite sides of the apparatus which are enlarged at the lower ends thereof as perhaps may best be seen with reference to FIG. 7A. By depressing these enlarged ends as illustrated by the curved arrow in FIG. 7A, the support 28 may be detached and removed in its entirety from the sleeve.

On the side thereof opposed to hinges 36, an apertured projection 42 is also formed on bottom support plate 32. Pivotally attached to projection 42 at opposed ends thereof are link elements or arms 44 having apertures formed therein along a portion of the lengths thereof. A reinforcement plate 46 is connected to the sleeve 16 below the handle 26 by mechanical fasteners. Link elements 50 having apertures therein are pivotally connected to reinforcement plate 46. A lock pin 51 is utilized to extend through aligned apertures of the link elements 44, 50 to lock the bottom support plate at a desired angle relative to the top support plate. It will be appreciated that such angle may be readily varied and maintained by matching up different sets of apertures of the link elements 44, 50. The aperture in projection 42 will accommodate the large end of the associated latch member 40 when the top and bottom support plates are locked into face to face engagement, i.e., define a zero angle therebetween.

Figure 4:
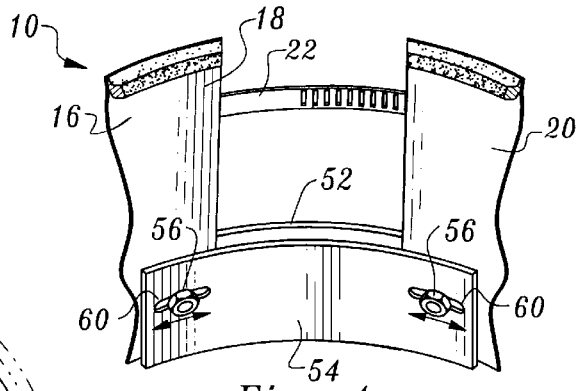
FIG. 4 is a perspective view taken from the inside of the apparatus and looking forward, illustrating details of structure associated with stabilizer means employed to stabilize sleeve ends.
Figure 5:
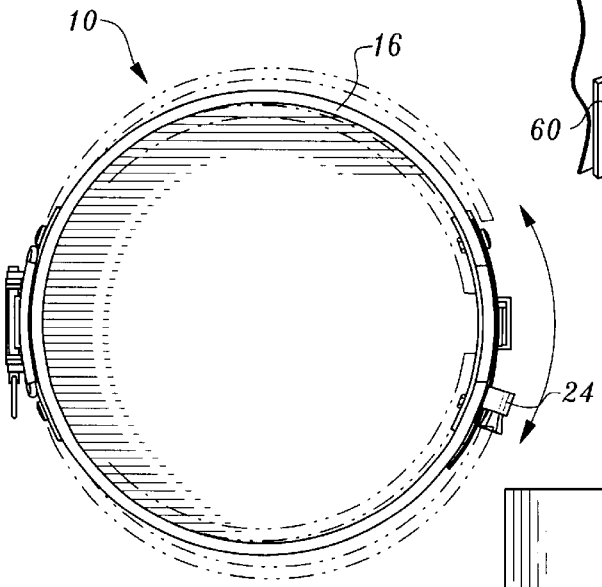
FIG. 5 is a top plan view showing the sleeve of the apparatus in various conditions, the sleeve being shown in both solid and dash lines.
Figure 6:
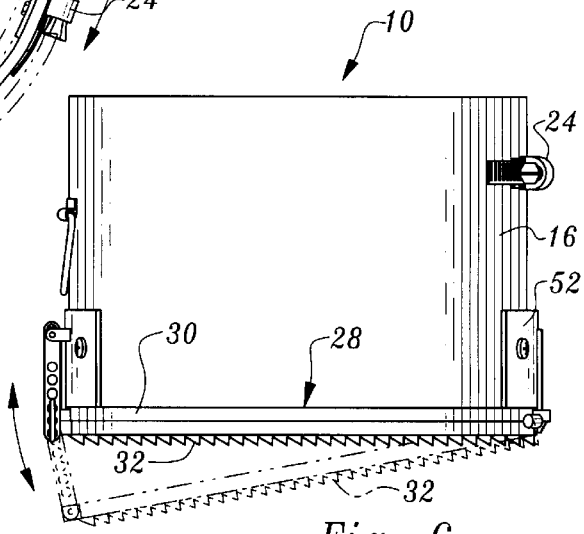
FIG. 6 is a side elevational view of the apparatus showing a support member thereof in two different conditions.
Figure 7:
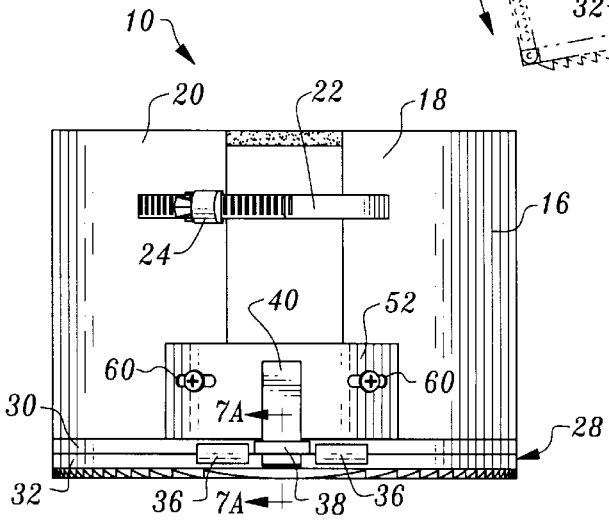
FIG. 7 is a front elevational view of the apparatus.
Figure 7A:
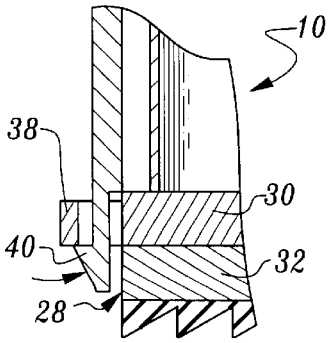
FIG. 7A is a greatly enlarged fragmentary view taken along the line 7A—7A in FIG. 7.

Located at the hinged side of the apparatus and spanning the gap between the sleeve ends 18, 20 is a pair of curved stabilizer plates 52, 54 which extend beyond the sleeve ends 18, 20 and define a space therebetween accommodating the sleeve ends. These curved stabilizer plates function to stabilize the sleeve ends while allowing the sleeve ends to move relative to one another due to the interaction between adjustment band 22 and manually actuatable member 24. Referring to FIG. 4, it may be seen that mechanical fasteners 56 interconnect the curved stabilizer plates 52, 54, it being understood that the mechanical fasteners also extend through openings (not shown) at the sleeve ends. Slots 60 are formed in both of the curved reinforcement plates to allow relative movement between the sleeve ends and the reinforcement plates. Alternatively, the reinforcement plates may be free of slots and slots provided in the sleeve ends for such purpose. The latch member 40 at the hinge side of the apparatus depends from stabilizer plate 52.

The above described arrangement provides a high degree of stability to a paint bucket being held by the apparatus. Furthermore, the sleeve portion may be utilized without the support, if desired.

Figure 8:
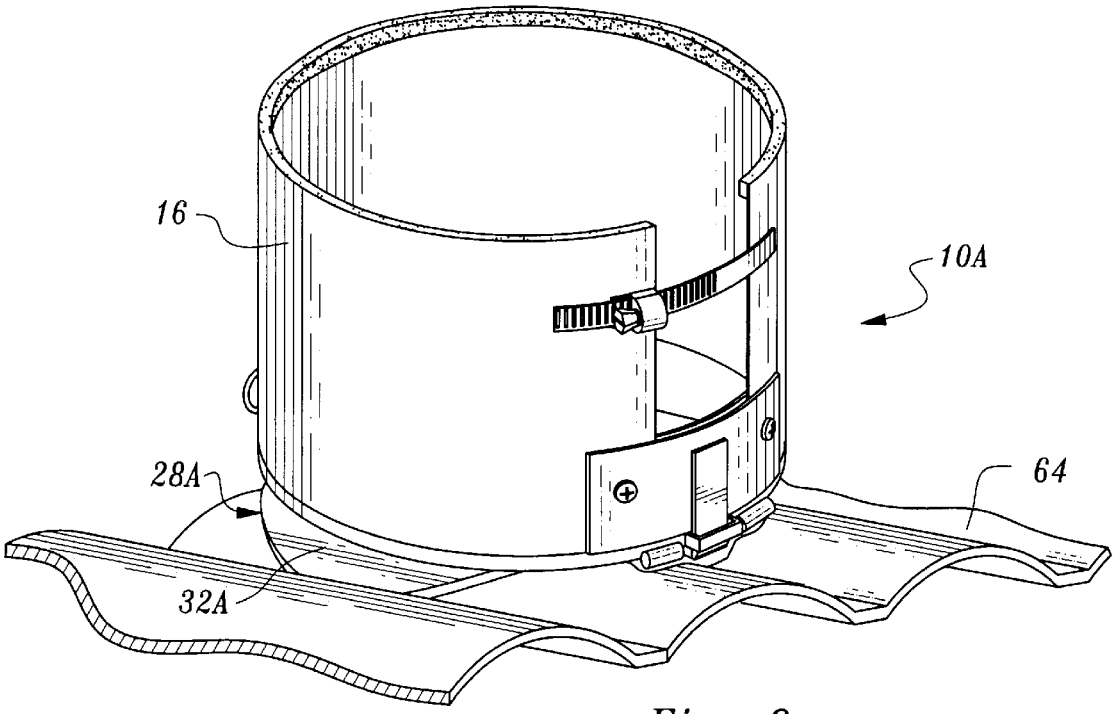
FIG. 8 is a perspective view illustrating an alternate form of support utilized in the apparatus to support the apparatus on an undulating tile roof.
Figure 9:
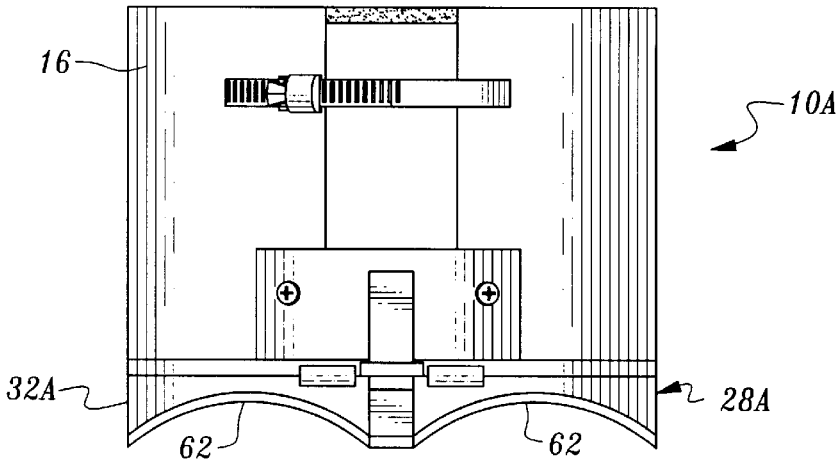
FIG. 9 is a front elevational view of the apparatus in the form shown in FIG. 8.

Referring now to FIGS. 8 and 9, an alternative form of apparatus, apparatus 10A, is shown. The apparatus 10A is identical in most respects to apparatus 10 described above, however, the support 28A of apparatus 10A differs from that utilized in apparatus 10. More particularly, the bottom support plate 32A differs from bottom support plate 32 in that bottom support plate 32A forms two curved concavities 62 which conform to the curves of a tile roof 64. That is, in the apparatus of the present invention, a plurality of supports having different configurations is employed, the supports being interchangeable to accommodate and adapt the apparatus to different shaped inclined surfaces. This feature contributes to the stability and utility of the apparatus.

The invention claimed is:

1. Apparatus for holding a paint bucket or other container in level condition on an inclined surface, said apparatus comprising, in combination:

a sleeve for at least partially encircling an outer peripheral surface of the container;

sleeve adjustment means for varying the size of the sleeve for selectively alternatively either bringing said sleeve into clamping engagement with the outer peripheral surface of the container or disengaging the sleeve from clamping engagement with the outer peripheral surface of the container;

a support for positioning under the bottom of the container and including a first support member and a second support member, said first support member and said second support member being hingedly interconnected by hinge means at adjoining edges thereof whereby said first support member and said second support member may be relatively positioned to define different angles therebetween;

connector means releasably connecting said support to said sleeve; and lock means for selectively locking said first support member and said second support member against movement in each of said different angles.

2. The apparatus according to claim 1 wherein said first and second support members respectively comprise a top support plate and a bottom support plate.

3. The apparatus according to claim 2 wherein said connector means comprises a plurality of spaced latches releasably attaching said top support plate to said sleeve.

4. The apparatus according to claim 2 wherein said bottom support plate has a slip resistant surface.

5. The apparatus according to claim 1 additionally comprising a carrying handle attached to said sleeve.

6. The apparatus according to claim 1 wherein said support is one of a plurality of supports having different configurations, said supports being interchangeable to accommodate and adapt the apparatus to different shaped inclined surfaces.

7. The apparatus according to claim 1 wherein said sleeve has spaced sleeve ends and wherein said sleeve adjustment means includes an adjustment band extending between said sleeve ends and manually actuatable means for tensioning said adjustment band.

8. The apparatus according to claim 7 additionally including stabilizer means stabilizing said sleeve ends.

9. The apparatus according to claim 8 wherein said stabilizer means comprises a pair of curved stabilizer plates defining a space therebetween accommodating said sleeve ends.

10. The apparatus according to claim 9 wherein said curved stabilizer plates are interconnected by mechanical fasteners, at least one of said curved stabilizer plates defining slots slidably accommodating said mechanical fasteners.

11. The apparatus according to claim 1 wherein said lock means includes interconnected link elements extending between said first support member and said second support member at a location generally diametrically opposed to the location of said hinge means.

12. The apparatus according to claim 11 wherein said link elements define apertures, said lock means additionally including a lock pin extending through aligned apertures of said link elements.

* * * * *